United States Patent [19]

Strok

[11] Patent Number: 4,580,075

[45] Date of Patent: Apr. 1, 1986

[54] HIGH PRESSURE SODIUM LAMP HAVING IMPROVED COLORING RENDITION

[75] Inventor: Jack M. Strok, Garrettsville, Ohio

[73] Assignee: General Electric Company, Schenectady, N.Y.

[21] Appl. No.: 682,807

[22] Filed: Dec. 17, 1984

Related U.S. Application Data

[63] Continuation of Ser. No. 444,778, Nov. 26, 1982, abandoned.

[51] Int. Cl.[4] ..... H01J 61/18; H01J 61/34

[52] U.S. Cl. ..... 313/25; 313/573; 313/572; 313/636; 313/642

[58] Field of Search ..... 313/636, 25, 634, 573, 313/570, 637, 572, 642

[56] References Cited

U.S. PATENT DOCUMENTS

| | | | |
|---|---|---|---|
| 3,248,590 | 4/1966 | Schmidt | 313/637 X |
| 4,109,175 | 8/1978 | Watarai et al. | 313/634 X |
| 4,285,732 | 8/1981 | Charles et al. | 106/57 |

*Primary Examiner*—David K. Moore
*Assistant Examiner*—K. Wieder
*Attorney, Agent, or Firm*—John P. McMahon; Philip L. Schlamp; Fred Jacob

[57] ABSTRACT

A high pressure sodium lamp operated at increased pressure and having an improved color rendition is disclosed. The improved high pressure sodium lamp has an arc tube which reduces the sodium losses typically experienced by high pressure operation.

4 Claims, 1 Drawing Figure

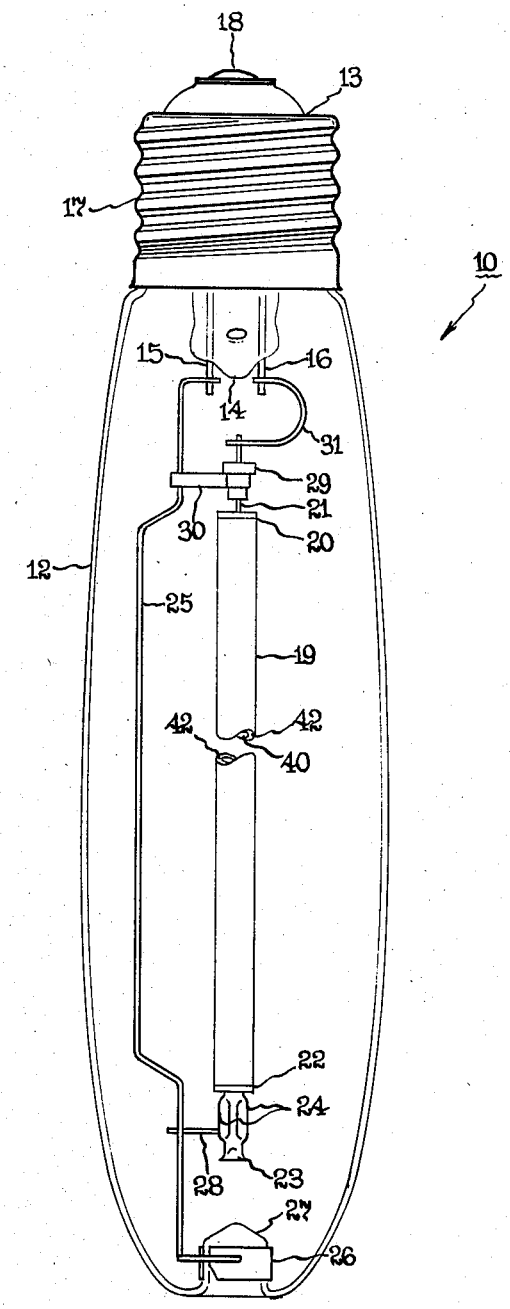
18
13
17
10
15
16
14
31
29
21
30
20
12
25
19
42
42
40
22
24
28
23
27
26

HIGH PRESSURE SODIUM LAMP HAVING IMPROVED COLORING RENDITION

This application is a continuation of application Ser. No. 444,778, filed Nov. 26, 1982 now abandoned.

CROSS REFERENCE TO RELATED APPLICATION

U.S. patent application Ser. No. 444,777 filed concurrently herewith, for "Increased efficacy high pressure sodium lamp yielded by increased wall temperature operation of C. I. McVey, assigned to the same assignee of the present invention, is related to the present invention.

BACKGROUND OF THE INVENTION

This invention relates to a high pressure sodium vapor lamp utilizing alumina ceramic inner envelope and is particularly concerned with a high pressure sodium lamp having an inner arc tube of alumina ceramic operated at a relatively high pressure and having a desired color rendition which is maintained during the life of the high pressure sodium lamp.

High pressure sodium vapor lamps have found widespread use during the past decade for commercial lighting applications, especially outdoor lightings. Such lamps are described in U.S. Pat. No. 3,248,590-Schmidt, High Pressure Sodium Vapor Lamps. High pressure sodium lamps typically utilize a slender tubular inner envelope of transmissive refractory oxide material resistant to sodium at high temperatures, suitably high density polycrystalline alumina or electron emissive material. The ceramic arc tube is generally supported within an outer vitereous envelope or jacket provided at one end with the usual screw base. The electrodes of the inner envelope are connected to terminals of the base, that is to shell and center contacts. The space between the inner and outer envelope is typically evacuated in order to conserve heat.

The color rendition of standard high pressure sodium (HPS) lamps may be improved by increasing the internal sodium partial pressure within the arc chamber of the inner envelope formed of polycrystalline alumina. An improved color rendition of a standard HPS lamp may desire that the polycrystalline alumina arc chamber be operated with two to three times the internal sodium partial pressure relative to a conventional standard HPS lamp. In addition, for such increased sodium pressure the wall temperature between electrode tips within the arc chamber may be increased by 100° C. relative to a standard HPS lamp in order to offset the reduction of luminous efficacy which normally accompanies operation at increased sodium pressures. Higher internal sodium pressures as well as higher arc chamber wall temperature typically shortens the life of improved color HPS lamps relative to their standard color, high efficacy HPS lamp counterparts. For example, manufacturers of improved color high pressure sodium lamps typically classify their products at 8,000–10,000 life hours as compared to 20,000–30,000 life hours for standard color products.

The life reduction of improved color HPS lamps typically occurs by the major factors of sodium losses from the arc chamber due to reactions with the inner surface of the arc chamber and through migration of the sodium though the walls of the arc chamber. Sodium losses result in HPS lamp voltage rise, decrease of correlated color temperature of the HPS lamp, decrease of color rendition index and a color shift from a desired warm white color to an undesired pink color. In addition, the sodium which migrates through the arc chamber deposits on the inside wall of the evacuated outer chamber where reaction with the glass and evaporation products from the alumina arc chamber cause a brownish stain on the outer chamber, which, in turn, reduces the light output of the HPS lamp. The brownish stain further aggravates undesirable lamp voltage rise of the HPS lamp.

Accordingly objects of the present invention are to provide means for reducing the loss of sodium from an improved color HPS lamp operated at relatively high pressures contributed by the sodium within the arc chamber of the HPS lamp, and to provide such a high pressure sodium lamp having a color rendition index which remains substantially constant over the life of the improved color HPS lamp.

These are the objects of the present invention and will become more apparent upon consideration of the following description of the invention.

SUMMARY OF THE INVENTION

This invention is directed to an improved color rendition high pressure sodium lamp operated at increased sodium pressures and having means for reducing the sodium losses typically created by the increased sodium high pressure operation.

Accordingly, in one embodiment of the present invention, a high pressure metal vapor lamp having an outer vitreous envelope enclosing an inner arc tube having thermionic electrodes sealed in its ends and containing a charge of vaporable metal having a sodium partial pressure in the range of 100 to 300 torr and xenon having a pressure in the range of 10 to 30 torr is disclosed. The inner arc tube has a chamber comprised of an optically translucent polycrystalline alumina ceramic chamber formed of the composition containing MgO and has an additive selected from the group consisting of $ZrO_2$ $HfO_2$ and mixtures thereof. The high pressure vapor lamp according to the present invention has a general color rendition index in the range of 50–85.

BRIEF DESCRIPTION OF THE DRAWINGS

The only drawing, FIG. 1, is a front elevational view of a high pressure sodium vapor discharge lamp according to the present invention.

DETAILED DESCRIPTION

A high pressure sodium vapor lamp 10 embodying the invention and corresponding to a conventional 400 watt size is illustrated in FIG. 1. The high pressure sodium (HPS) vapor lamp 10 comprises a vitreous outer envelope 12 with a standard mogul screw base 13 attached to the stem end which is shown uppermost in FIG. 1. A re-entrant stem press 14 has a pair of relatively heavy lead-in conductors 15 and 16 extending through the stem 14 and having outer ends of conductors 15 and 16 connected to the screw shell 17 and eyelet 18 of the base.

The HPS lamp 10 has an inner envelope or arc tube 19 centrally located within the outer envelope 12. The arc tube 19 is comprised of a length of light transmitting ceramic formed of a polycrystalline alumina ceramic which is translucent. The upper end of the arc tube 19 is closed by an alumina ceramic plug 20 through which extends hermetically a niobium inlead 21 which supports an upper electrode (not shown) within the arc tube 19. The lower end of arc tube 19 has a closure which comprises a ceramic plug 22 through which extends a thin-walled niobium tube 23. The niobium tube 23 serves both as an inlead for arc tube 19 and a reservoir for excess alkali metal and mercury of the arc tubes 19. The shank of the lower electrode (not shown) of arc tube 19 projects into tube 23 and is locked in place by crimping the tube 23 about the lower electrode at location 24 as shown in FIG. 1. The crimping leaves restricted channels which allow passage of the alkali metal and mercury in vapor form but prevents movement of a liquid amalgam whereby the lamp may be burned not only base-up, as shown in FIG. 1, but also burned as base-down. The ceramic seals are described in greater detail in U.S. Pat. No. 4,065,691-McVey, Ceramic Lamp Having Electrode Support by Crimp Tubular Inleads.

The arc tube 19 is of primary interest to the present invention and is illustrated in FIG. 1 as partially broken-away so as to partially show the arc chamber 40 and the walls 42 both of arc tube 19. The walls 42 have a thickness in the range 0.5 to 1.5 mm. The arc tube 19 comprises an optically translucent polycrystalline alumina ceramic formed of a composition containing magnesium oxide (MgO) and having an additive selected from the group consisting of zirconium oxide ($ZrO_2$), hafnium oxide ($HfO_2$) and mixtures thereof. The inner tube 19 is formed of 633 ppm by weight of MgO and 400 ppm of the additive selected from the group consisting of $ZrO_2$, $HfO_2$ and mixtures thereof. The HPS vapor lamp 10 of FIG. 1 having the arc tube 19 has a general color rendition index in the range of 50–85. The arc tube 19 formed of alumina and containing MgO, along with the additives $ZrO_2$ and $HfO_2$ is described in U.S. Pat. No. 4,285,732-Aluminum Ceramic, assigned to the same assignee of the present invention and herein incorporated by reference.

U.S. Pat. No. 4,285,732 describes a method for producing an optically translucent polycrystalline sintered body through which light or radiation in the visible wavelengths is able to pass through sufficiently to make such body useful for optical applications such as enclosures for arc tubes such as arc tube 19. I have determined that an arc tube such as my arc tube 19, having the compositions described in U.S. Pat. No. 4,285,732, has an unexpected and surprising superior characteristic of reducing the undesirable sodium losses within the arc tube 19 described in the "Background" section, which, in turn, provides a HPS lamp operable at increased pressures so as to improve the color rendition and also the color rendition of the improved lamp is maintained over increased life.

Reference is now made to Table 1 showing typical HPS parameters relative to a standard HPS lamp and my improved color HPS lamp 10.

TABLE 1

| HPS Parameters | Standard HPS Lamp | Color Improved HPS Lamp 10 |
|---|---|---|
| Bore | 7.25 mm | 7.25 mm |
| Arc Gap | 87 mm | 44 mm |
| Wall Loading | 18.0 w/cm$^2$ | 22.0 w/cm$^2$ |
| Amalgam | 25% Na | 25% Na |
| Xenon Fill | 17 Torr | 17 Torr |
| Cold Spot | 680° | 720° |
| Max Wall Temperature | 1140° | 1105° |
| Sodium Pressure | 60 Torr | 120 Torr |

TABLE 1-continued

| HPS Parameters | Standard HPS Lamp | Color Improved HPS Lamp 10 |
|---|---|---|
| Efficacy | 125 LPW | 90 LPW |
| X, Y | .512, | .505, |
| Chromaticity | .420 | .410 |
| Cor. Color Temp. | 2100° K. | 2250° K. |
| Color Rendering Index | 20 | 65 |

The standard HPS lamp of Table 1 may be of the commercially available LU400 400 watt type available from the Lighting Business Group of the General Electric Company, whereas, the color improved lamp 10 of Table 1 is of a 250 watt type. A comparison between the standard HPS lamp and my color improved HPS lamp both of Table 1 reveals, (1) my improved color HPS lamp 10 has a Color Rendering Index of 65, whereas, the standard HPS lamp has a Color Rendering Index of 20, (2) my improved color HPS lamp 10 has a correlated color temperature (CCT) of 2250° K., whereas, the standard HPS lamp has a CCT of 2100° K., and (3) my improved color HPS lamp 10 has a sodium pressure of 120 Torr which is twice that of the standard HPS lamp having a typical sodium pressure of 60 Torr.

In order that the invention may be more fully appreciated, references is now made to comparative test data obtained between a standard HPS lamp and my improved color HPS lamp in accordance with the practice of this invention.

The standard HPS lamp with which the comparative test data was obtained was a 400 watt rating having a typical operating sodium partial pressure of 60 torr and having a general color rendition of 20. A total of 10 standards HPS lamps were subjected to comparative testing. The improved color HPS lamp 10 was similar to the standard HPS 400 watt lamp except that the HPS lamp 10 had the arc tube 19, previously described, having a selective additive of $ZrO_2$ and operated at a pressure in the range of 120 to 160 torr. A total of 10 improved HPS lamps were subjected to the comparative testing.

The groups of the standard and improved HPS lamps were subjected to operation at 800 watts for a 100 hour duration. During the testing at 800 watts, both groups were determined to have an increased, relative to the 400 watt operation, general color index of approximately 65 and both groups had a maxium ceramic temperature approximately midway between the associated electrode tips of approximately 1,350° C.

After the lamps were burned for approximately 100 hours, an inspection of the lamps was accomplished. The inspection revealed that subjecting of the standard HPS lamp to 800 watt operation created a dark brown staining of the outer envelope. However, the improved color HPS lamps 10 of the present invention only manifested a slight staining on their outer envelope. In addition, the arc tube chambers of the standards HPS lamps showed "white spot" concentrations of sodium beta-alumina, which extended into the arc chamber wall. This sodium beta-alumina is detrimental to the operation of the arc tube in that it chemically binds sodium making it unavailable for participation in the discharge condition of the arc tube and also the sodium beta-aluminum serves as a conductor path of sodium through the arc tube thereby further aggravating sodium losses and promoting arc tube jacket staining where it deposits. The arc tube 19 of the improved HPS lamps of the invention showed no "white spots." A Scanning Electron Microscope (SEM) analysis on the inner surface of the arc tube 19 showed some scattered "whiskers" of sodium beta-alumina but no heavy concentrations or evidence of penetration of sodium reaction through the wall of the arc tube 19.

It should now be appreciated that the practice of the present invention provided an improved color HPS lamp 10 operable at at a pressure in the range of 100 to 300 Torr and having a general color index of 65. It should be noted that although the comparative testing of the improved color HPS lamp 10 discussed hereinbefore determined the general color index of 65, the teachings of my invention along with my previous experience in the HPS lamp art contemplate a HPS lamp 10 having a general color index of approximately 85. Still further, although the hereinbefore given comparative testing description was related to a 400 watt HPS lamp 10 and the parameters of Table 1 was related to a 250 watt HPS lamp 10, it should be recognized that the practice of this invention contemplates lower wattage rating of HPS lamps such as 35 along with higher wattage ratings such as 1000.

What I claim as new and desire to secure by U.S. Letters Patent of the U.S. is:

1. A high pressure metal vapor lamp having an outer vitreous envelope enclosing an inner arc tube having thermionic electrodes sealed in its ends and containing a charge of vaporable metals having a sodium partial pressure in the range of 100 to 300 torr and xenon gas in the range of 10 to 30 torr, said inner arc tube comprising:

an optically translucent polycrystalline alumina ceramic formed of a composition containing MgO and having an additive selected from the group consisting of ZrO, $HfO_2$ and mixture thereof, and;

said inner arc tube in cooperation with the given sodium and xenon gas pressure ranges being effective for reducing the typically expected operational sodium losses while increasidng the operational life of said high pressure metal vapor lamp and providing a substantially constant improved color rendition.

2. A high pressure metal vapor lamp according to claim 1 having a general color rendition index in the range of 50–85.

3. A high pressure metal vapor lamp according to claim 1 wherein said inner arc tube is formed of 633 ppm MgO by weight and the additives $ZrO_2$, $HfO_2$ and mixtures thereof are 400 ppm by weight.

4. A high pressure sodium lamp according to claim 1 wherein said inner arc tube has a wall thickness in the range of 0.5 to 1.5 mm.

* * * * *